United States Patent [19]

Westphal

[11] Patent Number: 4,511,901

[45] Date of Patent: Apr. 16, 1985

[54] DEVICE FOR CONNECTING AND GUIDING THE INDIVIDUAL COLLAPSIBLE ELEMENTS OF A RIGID, COLLAPSIBLE ANTENNA REFLECTOR

[75] Inventor: Manfred Westphal, Bermatingen, Fed. Rep. of Germany

[73] Assignee: Dornier System GmbH, Friedrichshafen, Fed. Rep. of Germany

[21] Appl. No.: 397,093

[22] Filed: Jul. 12, 1982

[30] Foreign Application Priority Data

Jul. 22, 1981 [DE] Fed. Rep. of Germany ..... 3128926

[51] Int. Cl.[3] ..... H01Q 15/20

[52] U.S. Cl. ..... 343/915

[58] Field of Search ..... 343/915, 912

[56] References Cited

U.S. PATENT DOCUMENTS

| | | | |
|---|---|---|---|
| 3,064,534 | 11/1962 | Tumavicus | 343/915 |
| 3,618,111 | 11/1971 | Vaughan | 343/915 |
| 3,715,760 | 2/1973 | Palmer | 343/915 |
| 4,030,102 | 5/1977 | Kaplan et al. | 343/915 |

OTHER PUBLICATIONS

"Large Space Systems Technology", 1979, Nov. 7–8, 1979, pp. 38–41.

"LSST 1st Annual Technical Review", Advanced Sunflower Antenna, Concept Development, Nov. 7–8, 1979, pp. 34–58, developed by TRW.

*Primary Examiner*—E. Lieberman
*Assistant Examiner*—K. Ohralik
*Attorney, Agent, or Firm*—Ralf H. Siegemund

[57] ABSTRACT

This invention relates to an improvement in a collapsible antenna reflector with rigid, collapsible elements for high accuracy of contour, composed of a central panel and collapsible segments mounted thereto by means of joints, the improvement comprising means mounting the individual collapsible segments (5) so that in their collapsed state their contour curvature is equidirectional, with the individual collapsible segments being mounted perpendicularly to the central panel and being arranged from its periphery obliquely to the antenna axis.

2 Claims, 5 Drawing Figures

Figure 1B:
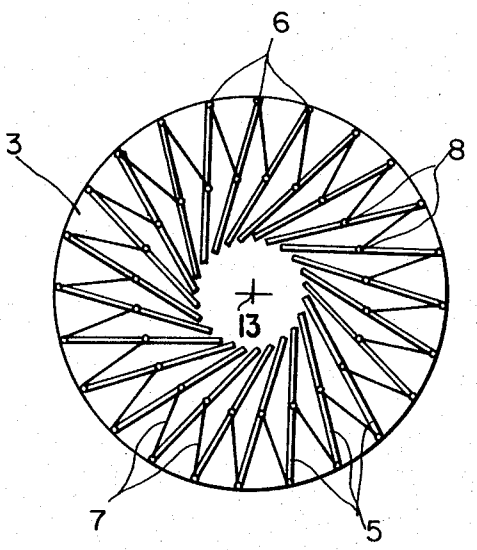

DEVICE FOR CONNECTING AND GUIDING THE INDIVIDUAL COLLAPSIBLE ELEMENTS OF A RIGID, COLLAPSIBLE ANTENNA REFLECTOR

This invention relates to a device for connecting and guiding the individual collapsing elements of a rigid, collapsible antenna reflector composed of a central panel and collapsible segments joined thereto by articulated means.

Space developments result in ever more powerful antenna systems which assume a core significance, for instance regarding communications, navigation, remote reconnaissance and energy transmission.

These increasing requirements lead to antennas of higher accuracy of contour and larger diameter. Using carbon fiber reinforced plastics (CFP) and rigid reflector dishes, it was possible to markedly improve contour accuracy, but the antenna size is limited by the extant space transport systems such as Ariane and Shuttle, these limits being primarily set by the size of the available payload room. Such limits can be exceeded only if the antennas are collapsed during transport and are unfolded once in orbit. Two alternatives are basically provided in this respect, namely the open-mesh reflector and the rigid reflector composed of rigid collapsible segments, the open-mesh reflector being eliminated from consideration because of the high accuracy requirements.

Various geometries are known as regards the rigid antennas reflectors composed of collapsible concavely shapped segments, such as that described in LARGE SPACE SYSTEMS TECHNOLOGY, 1979, 7–8 Nov. 1979, pp 38–41 and in LSST 1st Annual Technical Review, Advanced Sunflower Antenna, Concept Development, 7–8 Nov. 1979, pp 34–58, developed by TRW.

It is a drawback on one hand that a relatively large number of collapsible segments and associated articulated means are required to achieve an adequately large antenna diameter and on the other hand that the individual segments are only fastened, or held by their feet against the central panel. This unilateral fastening fails to provide an accurate final position of the segments once they have been unfolded because the individual segments may shift, because of a variety of circumstances, in their fastening means at the central panel. There is also the danger that the segments will be mutually interfering during the unfolding process, — for instance by friction between the segment foils, or by a summation of the support tolerances among other factors — whereby deformation of the segment foils or their blocking of the unfolding process might ensue.

Based on this state of the art, it is the object of the present invention to provide a device connecting the individual segments in such a manner that they remain mutually connected during unfolding and in their final positions, and are fixed in place so that thereby the accuracy of contour and the dimensional stability of the antenna reflector and the costs of locking of the individual segments is optimized.

The invention offers the advantage that the individual segments are connected together by at least one connecting rod hinged at least to their outer ends. In this manner, the collapsing segments are positively guided when in the intermediate positions of the unfolding process and are fixed into their final positions. The fixing can be implemented by the very connection rod(s) or by one or more additional known means, for instance stops and catch means. The position and the length of the connection rod(s) as well as the position of its hinge means or junction points at the ends of the collapsing segments are defined by the initial geometry and by the final position of the antenna. During unfolding, the connection rods cause additional rotation of the collapsible segments about an axis of rotation determined by a simple hinge means associated to each collapsible segment and mounted to the central panel, and comprising a spatially oblique axis, or by a universal joint. The collapsing segments and the connection rods are stretched and mutually fixed in place when in their final positions.

A minimum packed volume required for the initial or start-up geometry is achieved by the special shapes of the hinges mounted to the central panel which pivot far inward of the collapsible segments when in the packed state, so that the packed diameter corresponds nearly to the diameter of the central panel.

Figure 1A:
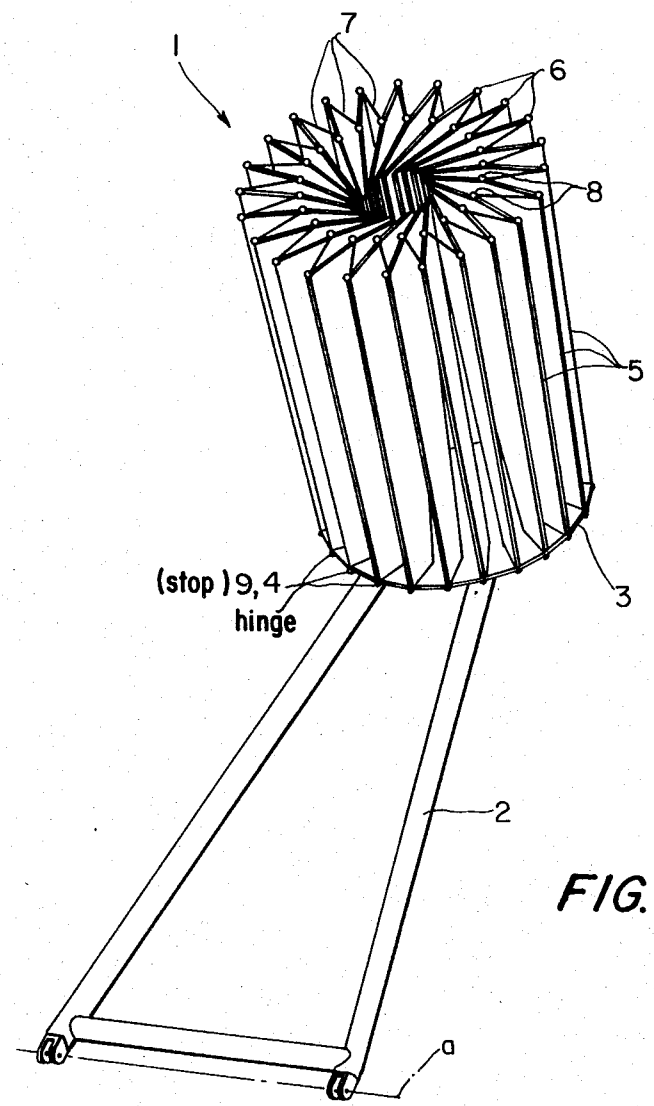
Figure 2B:
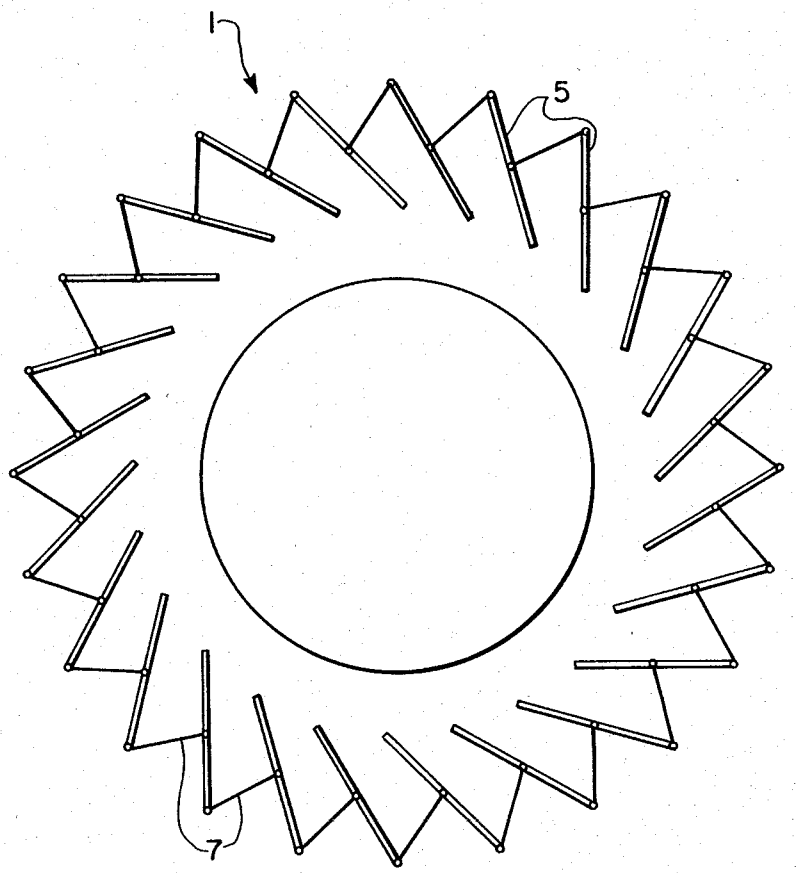
Figure 2A:
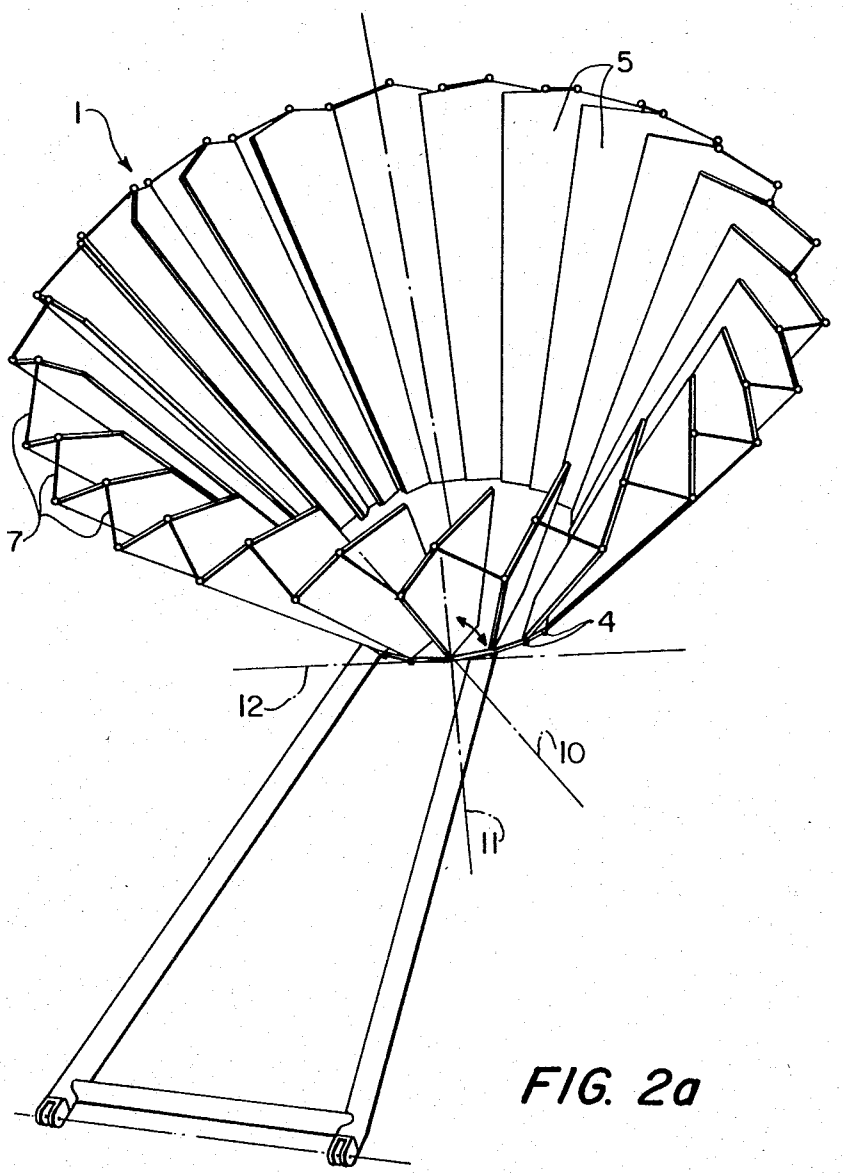
Figure 3:
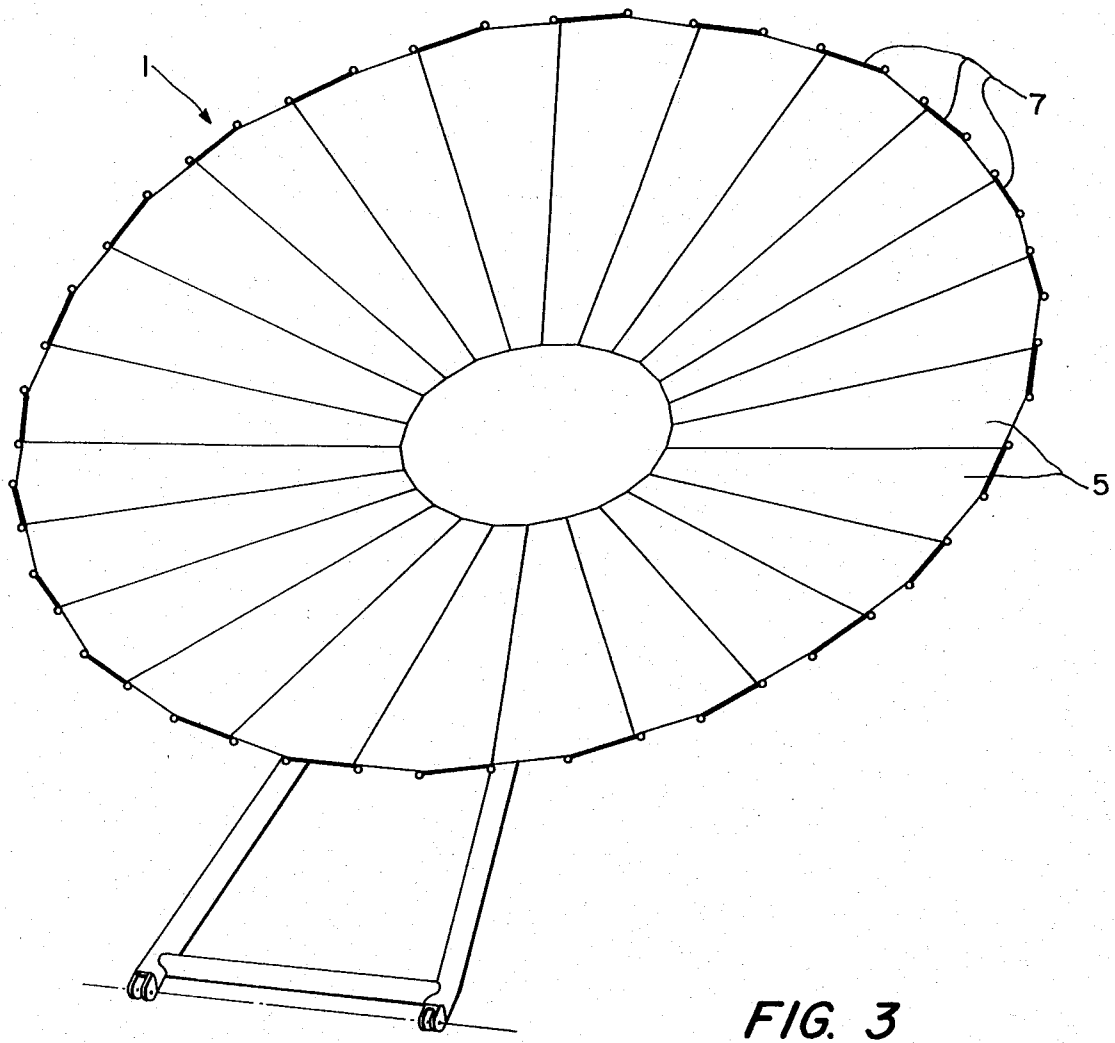

The invention will be further illustrated by reference to the accompanying drawings, in which:

FIG. 1*a* and 1*b* show an antenna reflector with collapsed segments,

FIG. 2*a* and 2*b* show the antenna reflector with the partly unfolded segments of FIGS. 1*a* and 1*b*, and FIG. 3 shows the antenna reflector in the final position with fully unfolded segments and fixed connection rods according to FIGS. 1*a* and 1*b*, and FIGS. 2*a* and 2*b*.

The antenna reflector 1 shown in FIG. 1*a* is mounted on a support 2, which tips about a shaft on a base (for instance the Shuttle) not shown in detail. A circular central panel 3 rigidly joins to the tapering end of the support 2; uniformly distributed joints 4 are mounted at the periphery of this central panel in a rigid manner and link the individual collapsible segments at their feet. The joints 4, depending on the design of the antenna reflector 1, may be plain hinges with slanting axes 10, or they may be universal joints respectively turning on transversly oriented axes 11, 12 (FIG. 2*a*). At the opposite, front end, the collapsible segments 5 are provided at their corners with joints 6 linked by connection rods 7 engaging joints 8 mounted in the outer end of each collapsible segment 5 and providing a mutual connection of the collapsible segments 5. When in the initial position the individual collapsible segments 5 are perpendicular to the central panel 3.

FIG. 1*b* is a top view showing the perpendicular position of the collapsed segments 5 to the central panel 3 mentioned in relation to FIG. 1*a* . Also longitudinal outer edges (one each) per panel are situated on a cylindrical surface that extends from the circular periphery of central panel 3. Reference numeral 13 refers to the central axis of the cylinder, which remains as axis of symmetry of the deployed antenna.

FIG. 1*b* shows the top edges of the perpendicularly positioned panels 5, and these edges do not extend on a radius of a circle as defined e.g. by the outer joints 6. These joints 6 on any panel are connecting points for the rods 7, whose respective other ends are connected to a central point on the upper edges of an adjacent panel. This connection is effected by joints 8 respectively.

FIGS. 2*a* and 2*b* show the antenna reflector 1 with partly unfolded segments 5 in perspective and in top view. Upon releasing a fastening means for the initial position, not shown in further detail in the Figures, the segments 5 unfold, for instance by a centrally located spring drive, not shown in further detail, or by means of one or more control units, again not shown in further detail. It is assumed that not all the segments 5 are driven individually by the guidance effect from the outer connection rods 7.

The joints 4 mounted to the central panel 3 provide a defined and simultaneous pivoting and rotating motion of the segments 5 during the unfolding process. Such joints are known per se, see e.g. U.S. Pat. No. 3,715,760. The rotation is constrained by the connection rods 7 mounted to the outer ends of the segments 5, the positions of these rods being so chosen that the joint 8 always connects the center of one segment 5 to the corner of the next segment 5. In this manner, a connecting chain is obtained which, in combination with the joints 4, guides and links the individual segments 5 to the central panel 3. In this manner complex locking means are eliminated. Alternatively, the positions of the joints 6 and 8 are variable. During the unfolding operation, the segments 5 rotate about the mutually orthogonal axes 11, 12 determined by a universal joint 4 and being so positioned that for simultaneous rotation (direction of arrow) of the segments 5 about the axis 11 (longitudinal axis), radial unfolding will become possible about the axis 12. The rotation of the segments 5 is constrained by the outer connection rods 7.

The final position of the unfolded segments 5 is reached when the connection rods 7 together with the collapsible segments 5 form the visible stretched position shown in FIG. 3, wherein they are mutually locked. This Figure shows, in a perspective view that a concavity is established by the panels 5 as now fully deployed.

Adjustable stop means 9 are provided to obtain a high accuracy of contour in the unfolded state of the antenna reflector 1, i.e., of its segments; these stop means are mounted at the joints 4 connecting the individual segments 5 to the central panel 3. This ensures accurate positioning of the segments 5 with respect to the central panel 3. The positioning in the circumferential direction and also the proper angular position of the individual segments 5 is secured by the connection rods 7 which fix these segments into their end positions.

It will be obvious to those skilled in the art that many modifications may be made within the scope of the present invention without departing from the spirit thereof, and the invention includes all such modifications.

What I claim is:

1. A collapsible antenna relfector, comprising a central panel having circular periphery;

a plurality of rigid tapered panels each having a lower edge, one end point of the edge being hingedly connected to the periphery of the central panel, for simultaneous rotating and pivoting so as to turn each panel and fold it outwardly from a folded position in what one longitudinal edge of each panel is situated on a cylinder surface; and a plurality of rods, each being hinged with one end to one upper end point on said longitudinal edge of a panel of the plurality of panels, and being hinged with its other end to a mid point of an upper edge of an adjacent panel.

2. A collapsible antenna reflector according to claim 1 including stop means fixing the collapsible segments (5) into their final positions.

* * * * *